US009458592B2

(12) United States Patent
Finkenzeller et al.

(10) Patent No.: US 9,458,592 B2
(45) Date of Patent: Oct. 4, 2016

(54) METHOD FOR ANCHORING A STRUCTURE IN A BED OF A BODY OF WATER AND UNDERWATER FOUNDATION

(71) Applicant: BAUER MASCHINEN GMBH, Schrobenhausen (DE)

(72) Inventors: Stefan Michael Finkenzeller, Reichertshofen (DE); Juergen Klippenstein, Augsburg (DE)

(73) Assignee: BAUER MASCHINEN GmbH, Schrobenhausen (DE)

( * ) Notice: Subject to any disclaimer, the term of this patent is extended or adjusted under 35 U.S.C. 154(b) by 0 days.

(21) Appl. No.: 14/409,391

(22) PCT Filed: May 10, 2013

(86) PCT No.: PCT/EP2013/059702

§ 371 (c)(1),
(2) Date: Dec. 18, 2014

(87) PCT Pub. No.: WO2013/189659

PCT Pub. Date: Dec. 27, 2013

(65) Prior Publication Data

US 2015/0167270 A1 Jun. 18, 2015

(30) Foreign Application Priority Data

Jun. 18, 2012 (EP) ..... 12004579

(51) Int. Cl.

| | |
|---|---|
| ***E02D 27/12*** | (2006.01) |
| ***E02D 27/42*** | (2006.01) |
| ***E02D 7/22*** | (2006.01) |
| ***E02B 17/00*** | (2006.01) |

(Continued)

(52) U.S. Cl.
CPC ..... *E02D 7/22* (2013.01); *E02B 17/0008* (2013.01); *E02D 5/56* (2013.01); *E02D 5/62* (2013.01); *E02D 27/12* (2013.01); *E02D 27/42* (2013.01); *E02D 27/50* (2013.01); *E02D 27/525* (2013.01)

(58) Field of Classification Search
CPC ..... E02D 27/425
USPC ..... 405/195.1–228
See application file for complete search history.

(56) References Cited

U.S. PATENT DOCUMENTS 2,881,591 A * 4/1959 Reeve ..... 405/224
3,546,885 A * 12/1970 Pogonowski ..... 405/227

(Continued)

FOREIGN PATENT DOCUMENTS

EP 2354321 A1 8/2011
NL 1026354 C2 12/2005

OTHER PUBLICATIONS

International Search Report; PCT/EP2013/059702; Apr. 17, 2014.

(Continued)

*Primary Examiner* — Tara M. Pinnock
(74) *Attorney, Agent, or Firm* — Studebaker & Brackett PC

(57) ABSTRACT

The invention relates to a method for anchoring a structure in a bed of a body of water comprising the method steps of introducing at least one screw anchor into the bed of the body of water, arranging and fastening a base element on the fastening section of the screw anchor, wherein the base element has a holder for the structure, and arranging and fastening the structure on the holder of the base element. Furthermore, the invention relates to an underwater foundation produced by this method.

12 Claims, 5 Drawing Sheets

(51) Int. Cl.

| | |
|---|---|
| ***E02D 5/56*** | (2006.01) |
| ***E02D 5/62*** | (2006.01) |
| ***E02D 27/50*** | (2006.01) |
| ***E02D 27/52*** | (2006.01) |

(56) References Cited

U.S. PATENT DOCUMENTS

| | | | | | |
|---|---|---|---|---|---|
| 3,716,994 | A | * | 2/1973 | Pogonowski | 405/204 |
| 4,339,899 | A | * | 7/1982 | Klenk et al. | 52/157 |
| 4,351,258 | A | * | 9/1982 | Ray et al. | 114/230.24 |
| 4,386,874 | A | * | 6/1983 | Engelsen et al. | 405/224 |
| 4,561,231 | A | * | 12/1985 | Hoyt et al. | 52/297 |
| 4,620,820 | A | * | 11/1986 | Collipp | 405/224 |
| 4,669,917 | A | * | 6/1987 | Sveen | 405/227 |
| 4,679,964 | A | * | 7/1987 | Blandford | 405/216 |
| 4,687,062 | A | * | 8/1987 | Beghetto et al. | 166/366 |
| 4,687,380 | A | * | 8/1987 | Meek et al. | 405/204 |
| 5,244,312 | A | * | 9/1993 | Wybro et al. | 405/204 |
| 5,332,336 | A | * | 7/1994 | Lewis | 405/204 |
| 6,036,404 | A | | 3/2000 | De Medeiros, Jr. et al. | |
| 6,318,933 | B1 | * | 11/2001 | De Medeiros et al. | 405/223.1 |
| 8,215,874 | B2 | * | 7/2012 | Reeves | 405/255 |
| 8,371,771 | B1 | * | 2/2013 | Lugo et al. | 405/227 |
| 8,845,235 | B2 | * | 9/2014 | Gibberd | 405/228 |
| 2011/0170956 | A1 | | 7/2011 | Vandenbulcke et al. | |

OTHER PUBLICATIONS

International Preliminary Report on Patentability and Translation of Written Opinion of the International Searching Authority; PCT/EP2013/059702 issued on Dec. 23, 2014.

* cited by examiner

METHOD FOR ANCHORING A STRUCTURE IN A BED OF A BODY OF WATER AND UNDERWATER FOUNDATION

FIELD OF THE INVENTION

The invention relates to a method for anchoring a structure in a bed of a body of water. Furthermore, the invention relates to an underwater foundation for a structure, in particular a wind power station.

DESCRIPTION OF RELATED ART

Underwater foundations especially in the offshore area are required to an ever increasing extent. Such underwater foundations serve to anchor various types of structures, for example wind power stations projecting from the water or turbines arranged underwater for tidal power stations. For underwater foundations of such type it is known that drilled piles are produced. In this process a cased or uncased drilling is produced in the bed of a body of water. Subsequently, the borehole is filled with a concrete slurry which hardens to form the drilled piles. Such a method is known from EP 2 354 321 A1 for instance.

However, the production of such concreted drilled piles is both time-consuming and labor-intensive. Moreover, when support tubes are used there is the problem that due to their relatively large contact surface the tubes are difficult to handle especially in the case of stronger underwater currents. In addition, drill cuttings accumulate during drilling, the disposal of which is laborious and may cause an undesired contamination of the body of water.

Furthermore, it is known that for an underwater foundation driven piles are introduced by means of a pile driving apparatus into a bed of a body of water. However, the impact pulses occurring during underwater operations lead to considerable acoustic emissions which can have a significant detrimental effect on the underwater fauna. Hence, in some fields of application these pile-driving methods are undesirable or not permitted for environmental reasons.

SUMMARY OF THE INVENTION

The invention is based on the object to introduce an underwater foundation into a bed of a body of water efficiently and particularly gentle at the same time.

A method according to the invention for anchoring a structure in a bed of a body of water comprises the method steps:

- introducing at least one screw anchor into the bed of the body of water, wherein a lower anchoring section is anchored in the bed of the body of water and an upper fastening section of the screw anchor projects from the bed of the body of water,
- arranging and fastening a base element on the fastening section of the screw anchor, wherein the base element has a holder for the structure, and
- arranging and fastening the structure on the holder of the base element.

A first basic idea of the invention resides in the fact that one or several screw anchors are provided as anchoring elements in the bed of a body of water. These bar- or rod-shaped screw anchors have one or several screw flights on their outer circumference so that they can be screwed in an efficient way through a rotational movement into a bed of a body of water. In this process there is no, or hardly any, accumulation of excavated soil. Moreover, the relatively slim screw anchors, which generally have a diameter ranging from 5 cm to 30 cm are also relatively easy to handle underwater.

Another aspect of the invention resides in the fact that the structure to be anchored is not fastened directly on the screw anchors. In fact, a base element for the foundation is arranged on the fastening section of the screw anchor projecting from the bed of the body of water. The base element has a holder which is adapted to the structure to be anchored. The base element is thus designed as an adapter link between the fastening section of the screw anchor and the bearing feet of a structure to be anchored.

The base element can be fastened exclusively on the fastening sections above the bed of the body of water or preferably be placed onto the bed of the body of water and pre-tensioned by a tensioning means with respect to the bed of the body of water. For the purpose of fastening and/or bracing a thread portion can be provided on the fastening section of the screw anchor, wherein the base element is fastened in a releasable manner on the screw anchor by means of appropriate threaded nuts or screws. The fastening can also comprise a clamping effected by means of clamping wedges or another kind of locking.

In this way, it is also easily possible to remove the base elements and, where appropriate, also the screw anchors through simple dismantling.

A preferred embodiment of the invention resides in the fact that for a base element a plurality of screw anchors is introduced in a predetermined arrangement pattern into the bed of the body of water and that the base element is fastened on the plurality of screw anchors. According to the structure to be anchored and the required bearing forces almost any number and arrangement of screw anchors can be chosen. By preference, between 4 and 20 screw anchors are provided for each base element. The screw anchors can preferably have a length ranging between 3 m and 25 m.

According to the invention, further flexibility for the underwater foundation is achieved in that several base elements are installed on the bed of the body of water. Hence, depending on the structure to be anchored one or several base elements can be provided. By preference, between 2 to 10 base elements are arranged so that the foundation load of a structure is distributed to this plurality of base elements.

According to the invention a particularly stable underwater foundation results from the fact that the base elements are installed in a predetermined arrangement, wherein the structure to be anchored has a scaffold-type jacket structure with a central receiving part located in the center and bearing feet arranged thereon that are fastened on the holders of the base elements. A jacket structure is a foot or base area of the entire structure, through which a load distribution is effected to the individual base elements. In particular, the jacket structure can have 3 or 4 struts that extend from a central receiving part, more particularly a central tube, to the lower bearing feet. The bearing feet preferably have a shaft-shaped design and can be inserted into correspondingly arranged tubular holders on the base elements and fastened by suitable locking means, in particular screw connections.

A further increase in strength of the underwater foundation is achieved in accordance with the invention in that before or after anchoring at least one ballast body is arranged on the base element. The ballast body can be a concrete or steel element. By increasing the load superimposed on the base element existing buoyant forces of the base element or the structure to be anchored are counteracted. This results in the screw anchors being relieved.

According to the invention a particularly gentle anchoring is accomplished in that the screw anchor is screwed with a drilling device into the bed of the body of water. For this purpose the drilling device can be arranged above or below water. By means of the drilling device an axial feed force can additionally be exerted on the screw anchor. By preference, the feed force of the screw anchor is applied solely or to a substantial part by the screw flight on the exterior of the screw anchor during rotation.

Depending on the bed of the body of water the required anchoring force can be applied solely by screwing the screw anchor in. For certain cases of application provision is made according to the invention for the screw anchor to be additionally anchored in the bed of the body of water by a binding agent which is injected into an outer circumferential area of the screw anchor. In particular, the binding agent can be injected by high-pressure injection through a central duct in the screw anchor via radial outlet nozzles on the anchoring section of the screw anchor into the outer circumferential area. This brings about an additional connection and an increase of the frictional forces between the screw anchor and the surrounding ground material.

Furthermore, according to the invention it is preferred that a mast is provided which is inserted into the central receiving part of the jacket structure and fastened thereon. The mast can extend, in particular, from the jacket structure located underwater in the upward direction beyond the water surface.

In accordance with the invention provision is furthermore made for an underwater foundation for a structure, wherein the underwater foundation has at least one screw anchor which is introduced into a bed of a body of water, wherein a lower anchoring section is anchored in the bed of the body of water and an upper fastening section of the screw anchor projects from the bed of the body of water, and at least one base element which is arranged underwater and fastened on the at least one screw anchor, wherein the base element has a holder for the structure. This underwater foundation is produced, in particular, by the method described above. As a result, the advantages outlined above are attained.

Basically, the base element can be a solid body. According to the invention it is preferred that the base element is designed in a scaffold-type manner. In this manner, the base element offers a lesser contact surface especially in the case of underwater currents. For a good load distribution an upper and a lower beam plane can be provided which are connected to each other via vertical supports.

Another advantageous embodiment resides in the fact that a base element has one or several holders for receiving the structure. The holders can be sleeve-shaped receiving parts or supports in particular, into which corresponding shaft-shaped bearing feet of the structure to be anchored are inserted and fastened therein.

To increase the superimposed load provision is made according to the invention in that on the base element one or several supporting areas for ballast bodies are designed. In particular, the supporting areas are provided on the upper side of the base element. If the weight of the ballast bodies is sufficiently high they do not require additional fastening. However, additional provision can be made for fastening bolts or further locking or fastening means to fix the ballast bodies on the base element.

The invention furthermore relates to a wind power station having a mast which is anchored into a bed of a body of water by means of the previously described underwater foundation. The wind power station comprises a mast of up to over 100 m in height, in the upper mast area of which a windmill with a generator is arranged that transforms a rotational movement of the windmill into electrical energy.

BRIEF DESCRIPTION OF THE DRAWINGS

In the following the invention is described further by way of preferred embodiments illustrated schematically in the drawings, wherein show.

DETAILED DESCRIPTION OF THE PREFERRED EMBODIMENT

Figure 1:
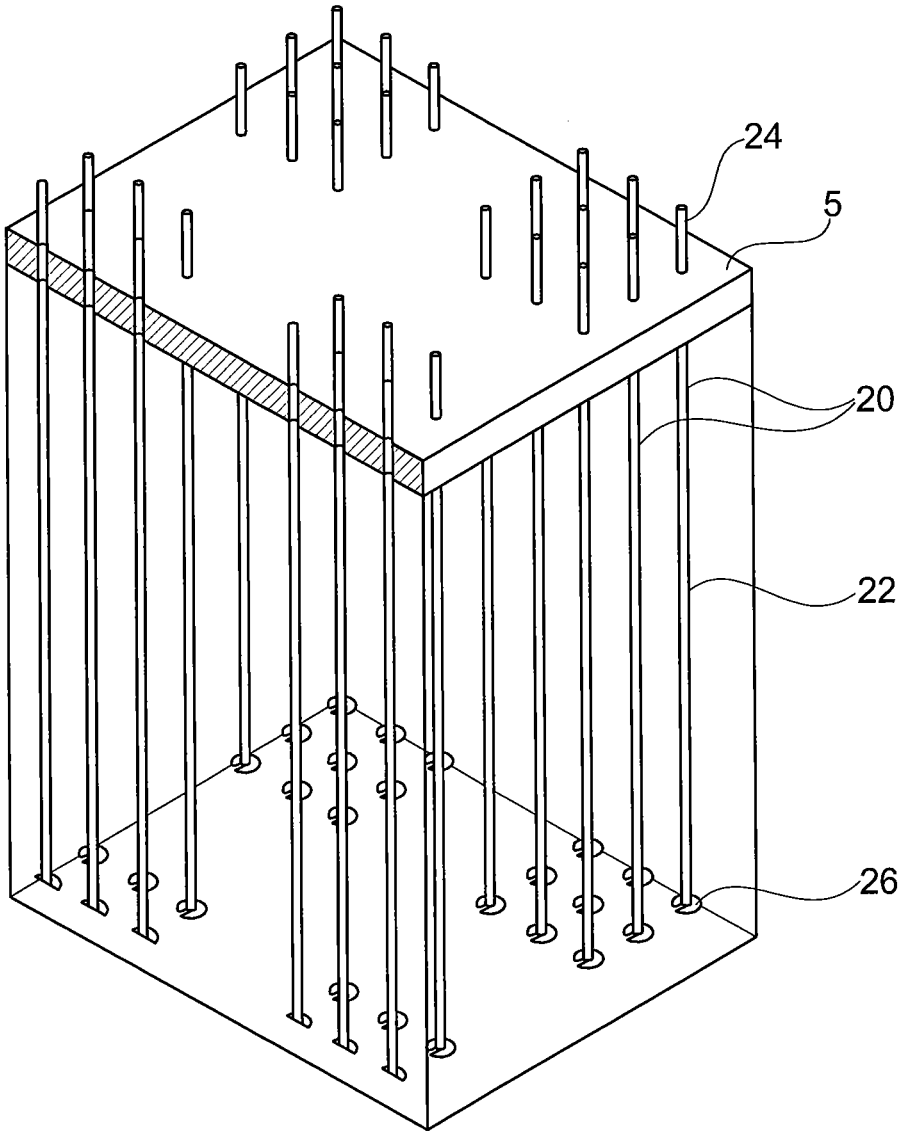
FIG. 1: a schematic view of screw anchors introduced in a bed of a body of water according to a first step of the invention.

According to FIG. 1 a plane, hence a substantially plane surface, is initially produced on a bed of a body of water 5. In the illustrated embodiment a plurality of screw anchors 20 is screwed into this area of the bed of the body of water 5 for a total of four base elements to be provided. The rod-shaped screw anchors 20 have a lower anchoring section 22 that is provided with a single screw flight 26 of approximately disk-shaped design. By means of a drilling apparatus, not illustrated here, the screw anchors 20 are drilled in a screw-like fashion into the bed of the body of water. For each of the four base elements to be arranged a total of nine screw anchors 20 are introduced in the illustrated embodiment in a square arrangement pattern with equal distance to each other. An upper fastening section 24, which accounts for approximately 10 to 20% of the total length of the screw anchor 20, projects from the bed of the body of water 5.

Figure 2:
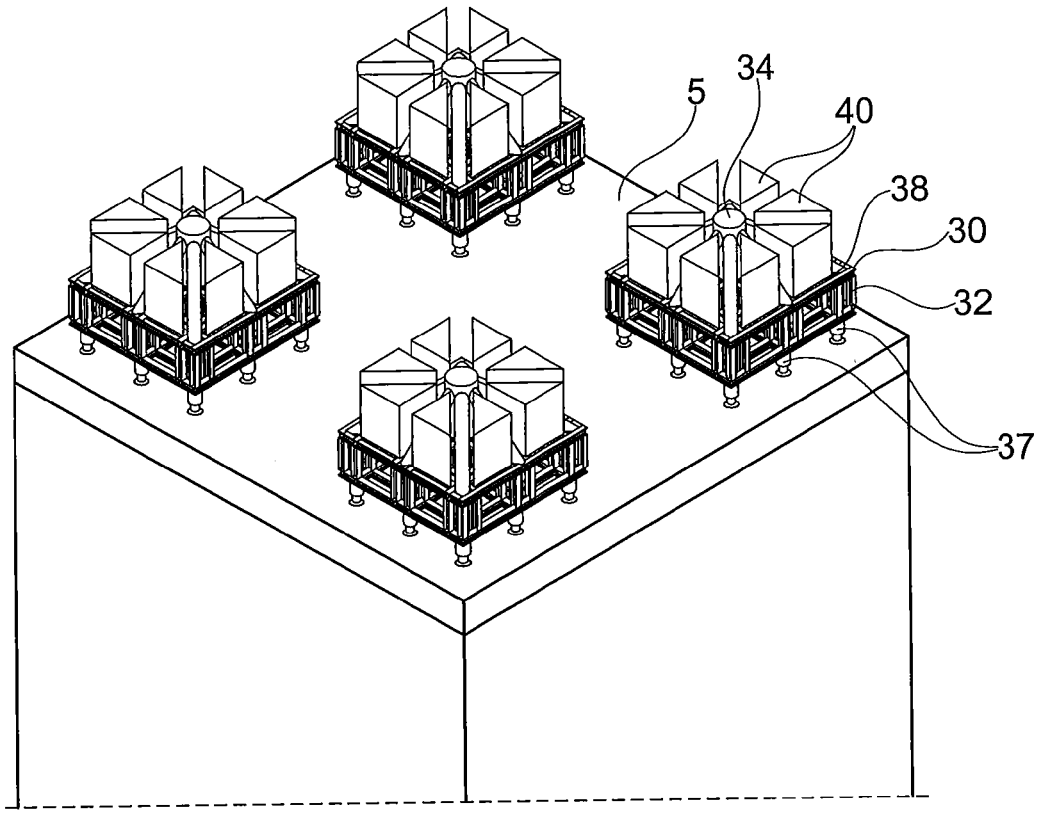
FIG. 2: a perspective view of the arrangement of base elements on the bed of a body of water according to a second step pursuant to the invention.

After this first method step scaffold-type base elements 30 are lowered from a ship or pontoon, not illustrated here, by means of a crane onto the bed of the body of water 5 and are positioned on the respective fastening sections 24 of the screw anchors 20, as can be seen from FIG. 2.

A base element 30 has a box-shaped scaffold frame 32 which is composed of H-beams. Corresponding to the arrangement pattern of the screw anchors 20 sleeve-shaped fastening means 37 are arranged. The base element 30 is positioned in such a way on the bed of the body of water 5 that the pencil-shaped fastening sections 24 of the screw anchors 20 fittingly project into the sleeve-shaped fastening means 37. By way of locking means, in particular screw connections, that are not illustrated here, the sleeve-shaped fastening means can be firmly connected to the fastening sections 24 of the screw anchors 20.

In a center area of the base element 30 a tubular central receiving part 34 for a structure to be anchored is arranged. Furthermore, on the upper side of the base element 30 supporting areas 38 are provided, onto which a total of eight identically constructed, prism-shaped ballast bodies 40 are placed.

Figure 3:
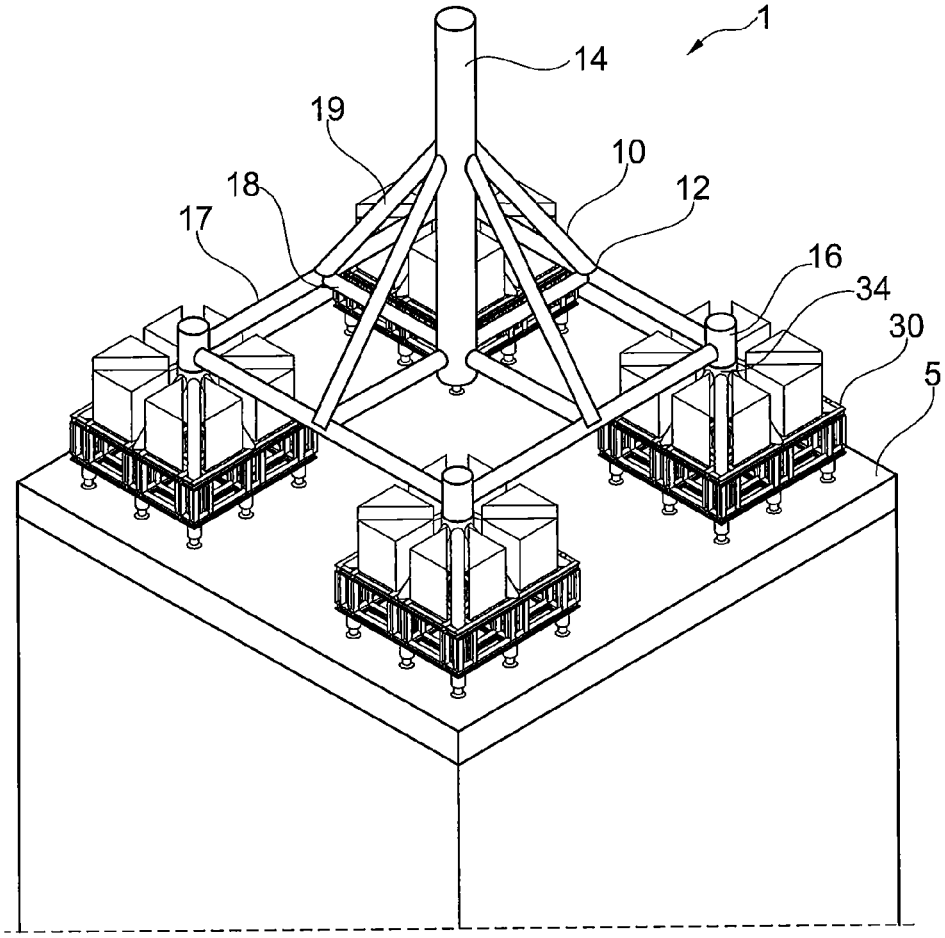
FIG. 3: the arrangement of a structure to be anchored on the base elements according to a third step pursuant to the invention.

After the base elements 30 have been arranged and fastened underwater on the bed of the body of water 5 the actual structure 10 to be anchored is lowered from the water surface and positioned in the holders 34 of the base elements 30, as becomes apparent from FIG. 3.

In the illustrated embodiment the structure 10 is designed as a so-called jacket structure 12 which can serve as a base area for receiving a mast, for example for a wind power station. According to the number of the base elements 30 provided this jacket structure 12 comprises four shaft-shaped vertically extending bearing feet 16 which are positioned in the sleeve-shaped holders 34 of the base elements 30 and fastened therein. The bolt-shaped bearing feet 16 are connected to each other through lateral struts 17 which surround a square. Within this arrangement a sleeve-shaped central receiving part 14 is arranged in the center which is connected via four central struts 18 and four diagonal struts 19 to the lateral struts 17 and therefore the bearing feet 16. The central receiving part 14 is provided for receiving and holding a mast. Following fastening of the jacket structure 12, which is usually located underwater, a mast can be lowered from the water surface and a mast base can be fastened in the central receiving part 14.

Figure 4:
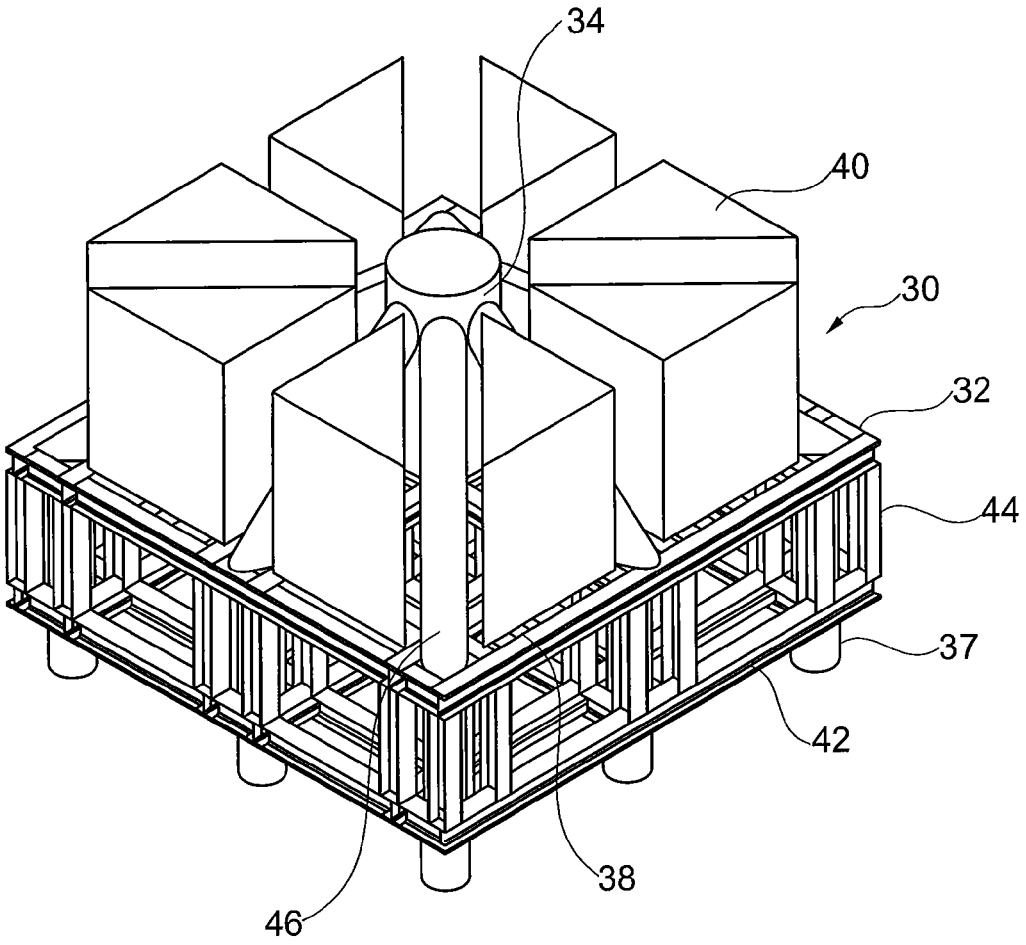
FIG. 4: a perspective view of a base element according to the invention.

According to FIG. 4 an embodiment of a base element 30 pursuant to the invention is shown in greater detail. The base element 30 has a scaffold frame 32 which essentially consists of two horizontal planes that are welded together in a lattice-type manner of horizontal beams 42. The upper and the lower horizontal planes are welded to each other by vertical supports 44 so that a cuboid scaffold frame 32 is formed.

According to the positions of the screw anchors 20 sleeve-shaped fastening means 37 extend vertically through the scaffold frame 32. At their upper end the outer sleeve-shaped fastening means 37 merge into a total of eight diagonal supports 46 that extend from the upper horizontal plane towards the central, vertically extending holder 34. Between the diagonal supports 46 on the upper side of the upper horizontal plane of the scaffold frame 32 supporting areas 38 are arranged, on which a total of eight prism-shaped ballast bodies 40 are arranged. The ballast bodies 40 are in particular formed of concrete and serve to secure the superimposed load.

Figure 5:
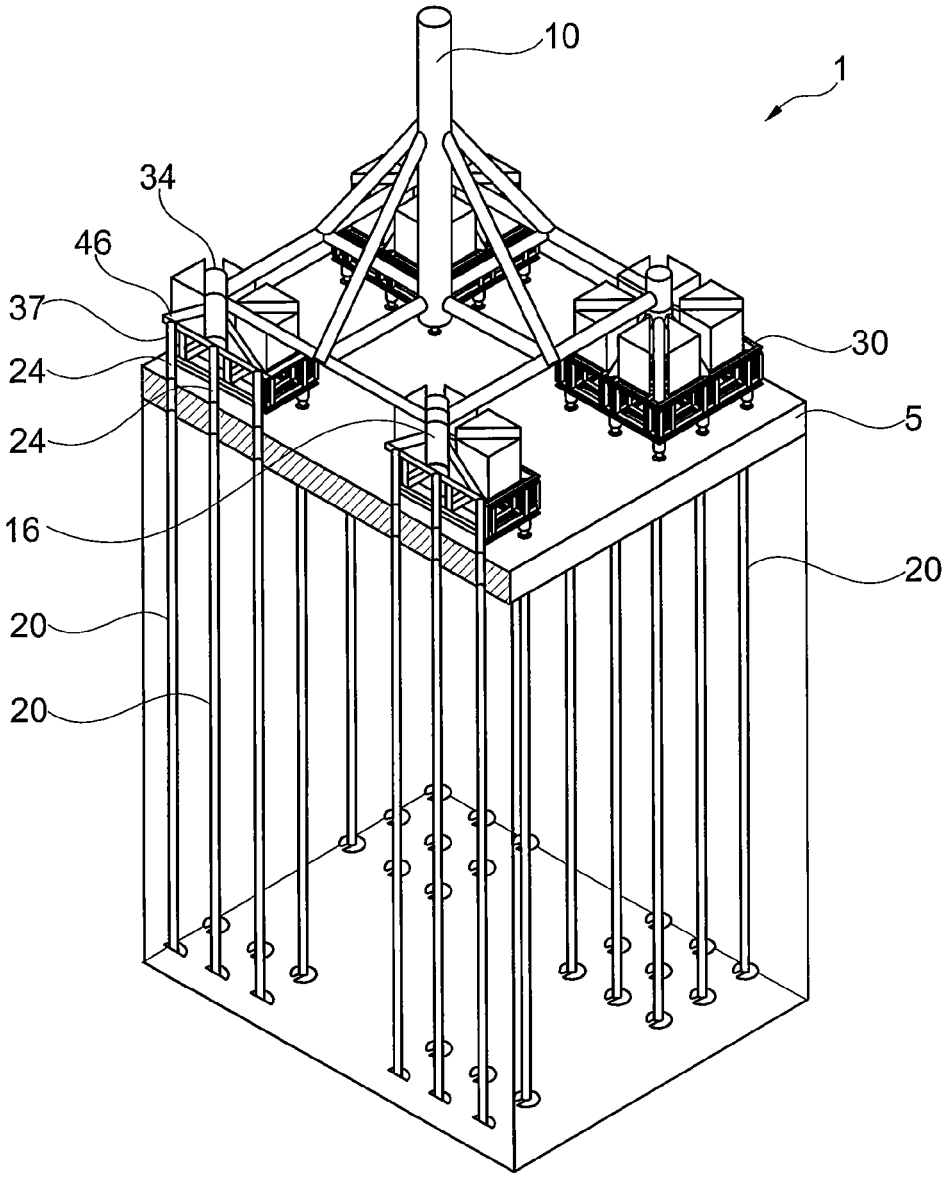
FIG. 5: a schematic view of an underwater foundation according to the invention.

All in all, an underwater foundation 1, illustrated schematically again in FIG. 5, is created by the method according to the invention. In the illustrated embodiment a total of four base elements 30 are arranged on the bed of the body of water and anchored by way of nine screw anchors 20 at a time in the bed of the body of water 5. The fastening of the base elements 30 is effected by sleeve-shaped fastening means 37, into which the bar-shaped fastening sections 24 of the screw anchors 20 extend. On the base elements 30 a central, tubular holder 34 is arranged in each case which is connected laterally via diagonal supports 46 to the tubular fastening means 37. The fastening means 37 located in the center of the base element 30 is connected directly to the central holder 34. A structure 10 is placed into the four holders 34 in total, in which case a total of four bearing feet 16 fittingly project into the holders 34 and are fastened therein.

The underwater foundation 1 is especially well-suited for offshore applications but can also be used in lakes, rivers or other bodies of water.

The invention claimed is:

1. A method for anchoring a structure in a bed of a body of water, comprising the steps of:

introducing a plurality of screw anchors arranged in arrangement patterns into the bed of the body of water such that each of the arrangement patterns includes three or more screw anchors, each of the plurality of screw anchors having a lower anchoring section anchored in the bed of the body of water and an upper fastening section projecting from the bed of the body of water, introducing a plurality of base elements, arranging and fastening each of the plurality of base elements on the fastening sections of the three or more screw anchors of the plurality of screw anchors, which are arranged in the respective arrangement pattern, wherein each of the plurality of base elements has a holder for the structure, and arranging and fastening the structure on the holders of the plurality of base elements, wherein each of the arrangement patterns spans a surface on the bed of the body of water, wherein each of the plurality of base elements comprises an upper end which is configured as an upper horizontal surface which is arranged above the three or more screw anchors arranged in the respective arrangement pattern, and the holder of each of the plurality of base elements is arranged on the upper horizontal surface of the respective base element.

2. The method according to claim 1, wherein the plurality of base elements are installed in a predetermined arrangement, wherein the structure to be anchored has a scaffold-type jacket structure with a central receiving part located in the center and bearing feet arranged thereon that are fastened on the holders of the plurality of base elements.

3. The method according to claim 2, further comprising inserting a mast into the central receiving part of the jacket structure and fastening the mast on the central receiving part.

4. The method according to claim 1, wherein before or after anchoring at least one ballast body is arranged on at least one of the plurality of base elements.

5. The method according to claim 1, wherein each of the plurality of screw anchors is screwed with a drilling device into the bed of the body of water.

6. The method according to claim 5, wherein at least one of the plurality of screw anchors is additionally anchored in the bed of the body of water by a binding agent which is injected into an outer circumferential area of the at least one of the plurality of screw anchors.

7. The method according to claim 1, wherein the holders of the plurality of base elements are designed as receiving tubes, into which shaft-shaped bearing feet of the structure are inserted.

8. An underwater foundation for a structure having a plurality of screw anchors arranged in arrangement patterns such that each of the arrangement patterns includes three or more screw anchors, each of the plurality of screw anchors being introduced into a bed of a body of water, and having a lower anchoring section anchored in the bed of the body of water and an upper fastening section projecting from the bed of the body of water, and a plurality of base elements, each of which is arranged underwater and fastened on the three or more screw anchors of the plurality of screw anchors, which are arranged in the respective arrangement pattern, and has a holder for the structure, and each of the arrangement patterns spans a surface on the bed of the body of water, wherein each of the plurality of base elements comprises an upper end which is configured as an upper horizontal surface which is arranged above the three or more screw anchors arranged in the respective arrangement pattern, and the holder of each of the plurality of base elements is arranged on the upper horizontal surface of the respective base element.

9. The underwater foundation according to claim 8, wherein each of the plurality of base elements is designed in a scaffold-type manner.

10. The underwater foundation according to claim 8, wherein at least one of the plurality of base elements has one or several holders for receiving the structure.

11. The underwater foundation according to claim 8, wherein one of the plurality of base elements, one or several supporting areas for ballast bodies are designed.

12. A wind power station having a mast which is anchored into a bed of a body of water by means of the underwater foundation according to claim 8.

* * * * *